United States Patent [19]

Aleman

[11] 4,069,521

[45] Jan. 24, 1978

[54] SYSTEM AND MEANS FOR USING WHITE WATERS IN BUILDINGS

[76] Inventor: Augusto Cuevas Aleman, Maria de la Luz Bringas No. 44, Colonia del Valle, Mexico 12, Mexico

[21] Appl. No.: 644,635

[22] Filed: Dec. 29, 1975

[51] Int. Cl.[2] ..... E03D 1/02; E03D 5/00

[52] U.S. Cl. ..... 4/300; 4/353; 4/379

[58] Field of Search ..... 4/1, 8, 10–12, 4/18, 26, 31, 41, 52, 57, 58, 63, 67 R, 67 A, 111, 115, 116, 287, 289, 3; 210/152, 167

[56] References Cited

U.S. PATENT DOCUMENTS

| | | | |
|---|---|---|---|
| 2,505,305 | 4/1950 | Schaefer | 4/289 |
| 3,041,630 | 7/1962 | Williams | 4/67 A |
| 3,112,497 | 12/1963 | Call | 4/10 |
| 3,183,525 | 5/1965 | O'Brien et al. | 4/10 |
| 3,611,447 | 10/1971 | Howard | 4/10 |
| 3,813,701 | 6/1974 | Stevens | 4/31 |
| 3,815,159 | 6/1974 | Delaney | 4/10 |
| 3,824,632 | 7/1974 | Bach et al. | 4/12 |
| 3,868,731 | 3/1975 | Stahl et al. | 4/10 |
| 3,874,006 | 4/1975 | Ritter | 4/287 |
| 3,934,276 | 1/1976 | Karlsson | 4/41 |

OTHER PUBLICATIONS

Aviation Week, December 1969, pp. 49, 50.

*Primary Examiner*—Richard E. Aegerter
*Assistant Examiner*—Stuart S. Levy
*Attorney, Agent, or Firm*—Albert L. Jeffers; Roger M. Rickert

[57] ABSTRACT

A system is disclosed wherein white waters, i.e., those soapy waters coming from washing stands, showers, wash basins and the like, are carried, through receiving and filtering devices, down to the tank or container of a toilet either at the same level of the building or down to a lower level. By means of the devices employed in this invention cesspools are dispensed within sanitary devices from which white water is obtained, and also water entrance valves and floaters in toilet tanks are dispensed with. A novel flushing valve is provided in the system, whereby leaks of water from the tank into the draining system, through the overflow duct in said tank is prevented; there being provided a special overflow tube through which the water in excess from a level in a building can be used in another lower level and so down to a cistern or the like wherein the excess water of the system is stored and from which said water is pumped up to a deposit or the like, from which said water is recirculated through every level of said building passing through every tank of said toilets.

4 Claims, 5 Drawing Figures

SYSTEM AND MEANS FOR USING WHITE WATERS IN BUILDINGS

BACKGROUND OF THE INVENTION

1. Field of the Invention

This invention relates to a system, as well as the devices necessary therefor, for the employment of white waters in houses, apartment buildings, office buildings or any other type of construction, either having one or several stands or levels, so as to be directed to the toilet tanks for the flushing thereof, instead of being disposed through the drain system, as usual.

2. Description of the Prior Art

To the best knowledge of the inventor, there is no prior art relating to a system for the use of white waters. Said waters usually are rejected directly or indirectly into the drain system, and therefore, there is only prior art relating to the devices employed in a drain system.

On the other side, all sanitary devices are presently provided with cesspools at the water outlet thereof, all cesspools being more or less of the same type. This invention eliminates the use of cesspools since it provides a special filtering and receiving valve, the main object of which is to avoid the air loads inside the conducts constituting the instant system. A similar valve is provided also in sewers in order to allow for the same to connect into the system of this invention, so as white waters are used at a level or stand lower than that wherein a sewer is provided, and so on.

An automatic flushing valve is also provided connected to a system of this invention. Said valve being provided with a seal bearing against its seat by means of the biasing of a spring, thus maintaining a wholly watertight seal preventing leaks as it is common in prior art toilets. It is also dispensed with the inlet valve and the floater since the tank of the toilet is directly connected to the sanitary devices from which white water can be obtained, through a system of vessels in communication.

The excess water in a given toilet tank is carried through an overflow tube, similar to those provided in the prior art toilet tanks. However, instead of being in communication with the toilet itself, said overflow tube is connected to a lower level of the system, or, in case of the lowest level, to drainage or sewer or else into a cistern or the like. The assembly of all these elements incorporated to the system of this invention, are different to the corresponding ones employed in systems or sanitary facilities of prior art.

SUMMARY OF THE INVENTION

This invention, in one of its embodiments provides a hydraulic system communicating those sanitary devices capable of producing white water, with the toilet tank or tanks, through a system of vessels in communication.

It is also provided by this invention a system wherein the white water from devices located at a lower point than the tank or tanks level, is sent down to a lower stand of the building or else is sent into a cistern in order to be recirculated therefrom, into the entire system.

In another embodiment of this invention, a novel toilet tank is provided wherein the feeding of the tank is carried out through the bottom thereof without inlet valve or floater, and wherein a novel flushing valve, spring-biased, is provided.

It is also provided at the system of this invention a toilet tank with auxiliar overflow tube, which tube is connected directly with a sub-system provided at a lower level or a building, in order to be in a position of sending the overflow water of a first tank, down to the tank of a toilet located at the lower level, or else into a cistern; the whole in a circuit different to that of a standard system.

It is also considered as a part of this invention the absence of a cesspool in every sanitary device and in every sewer sink and the like, there being substituted by removable filtering elements, capable of forming suitable reception chambers so as to prevent the rupture of said system of vessels in communication.

These and other further objects and advantages of this invention will become apparent when reading the following detailed disclosure of certain preferred embodiments of this invention; the scope of which is disclosed in the claims at the end of this disclosure.

DESCRIPTION OF THE PREFERRED EMBODIMENT

Figure 1:
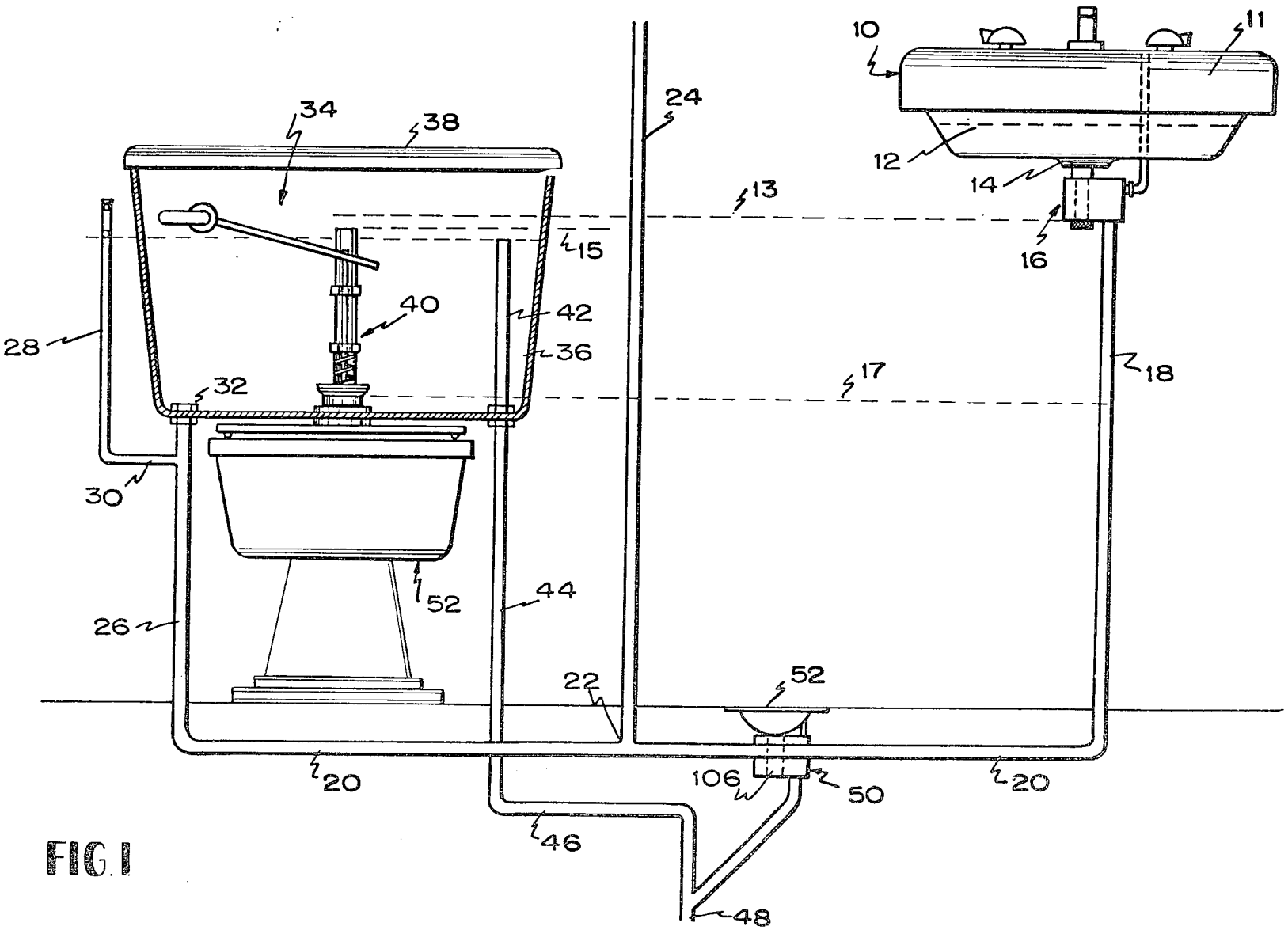
FIG. 1 is a partially diagrammatic sectional view of a system of this invention, adapted to serve just one and the same floor or level of a building, there being shown herein the connections to an upper and to a lower level.
Figure 4:
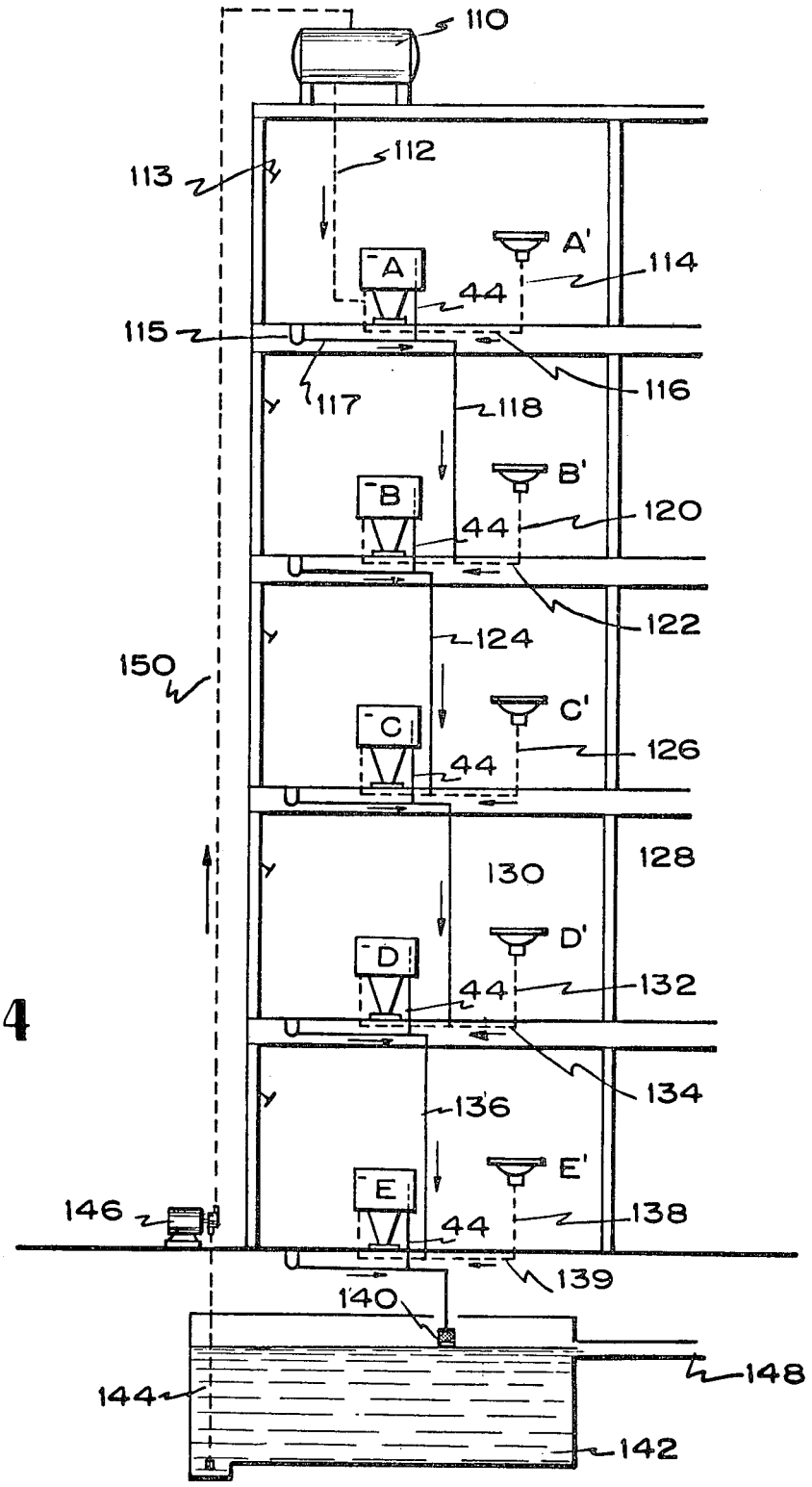
FIG. 4 is a schematic illustration of a system of this invention, suitable to be used in a multi-staged building; said system being equipped with a cistern, a recirculating pump and a top tank.

With reference first to FIG. 1, a system of this invention can be seen that is a hydraulic system entirely different to the standard sewage system employed in buildings. The system of this invention is formed generally by sanitary devices 10 capable of producing white waters. (In this disclosure and claims, the term "white waters" is used to designate soapy waters.) The outlet level of said sanitary devices 10 is situated at horizontal level higher than the overflow level of a toilet tank to be fed with said white waters of this system. Although in drawings is represented only one wash basin 11 as the source of white waters, those skilled in the art will understand that other sanitary devices, such as washing stands, and any other possible fountain of white waters, located above the level of the overflow tube, in a toilet tank. However, there are other further sources of white water, such as showers, tubs, cloth washers and the like, the outlet of which is located at a level lower than that of the toilet and, therefore, the water produced therefrom cannot be employed at the same stage but must be directed down to the lower stand, wherein said water can be used as shown in FIG. 4, or can be kept in a cistern in order to be recirculated therefrom.

Turning now to FIG. 1, a water volume 12, produced by the wash basin 11 is to be used as a feeding for the tank 34 of a toilet 52. To this end, the drain orifice 14 of said basin 11 is directly connected to a filtering device also serving as a pressure regulator, and generally identified with number 16. This device is, in turn, connected to a downward tubing 18 which, through a horizontal tubing 20, is connected to an upward tubing 26 connected to the bottom 32 of tank 34. In a point 22, said tubing 20 is receiving a tubing 24, coming from an upper stage or from a top container such as tank 110, shown in FIG. 4. From said tube 26 a branch 30 comes upwardly carrying a level indicator 28 outward said tank 34, which tank is also provided with a flushing valve generally shown at 40, and with an overflow tube 42, communicating with a downward tubing 44. Said tubing 44, through a tubing 46, is connected to a downward tubing 48 conducting into a lower stage or into a cistern, as already stated.

Said tank 34 is formed by a container 36 and a cover 38; while the interior thereof is in communication with the toilet bowl 52, through a conduct normally closed by said flushing valve 40. It will be noted that there is no inlet valve, since the principle of this system is that of the vessels in communication, since said wash basin 11 is located at such a height that the bottom of said pressure regulating and filtering device 16 is above the maximum level water can reach inside said tank 34. Thereby, said tank always can become full up to the mouth of said overflow tube 42, without a need of closing the communication of said tank with said basin 11, since the excess of water entering into said tank 34, will be carried down to the lower stage or into the cistern. On the other hand, the minimum water level at said system will be constituted, in a given moment, by the flushing valve seat. These three levels are clearly shown in FIG. 1 by numbers 13, 15 and 17, respectively.

As it will be obvious to those skilled in the art, an air column will be formed at the interior of said pressure regulating and filtering device when the toilet flushing valve is opened, said column preventing the free pass of water from said basin downwardly, unless a suitable means is provided to counteract that air chamber.

Figure 3:
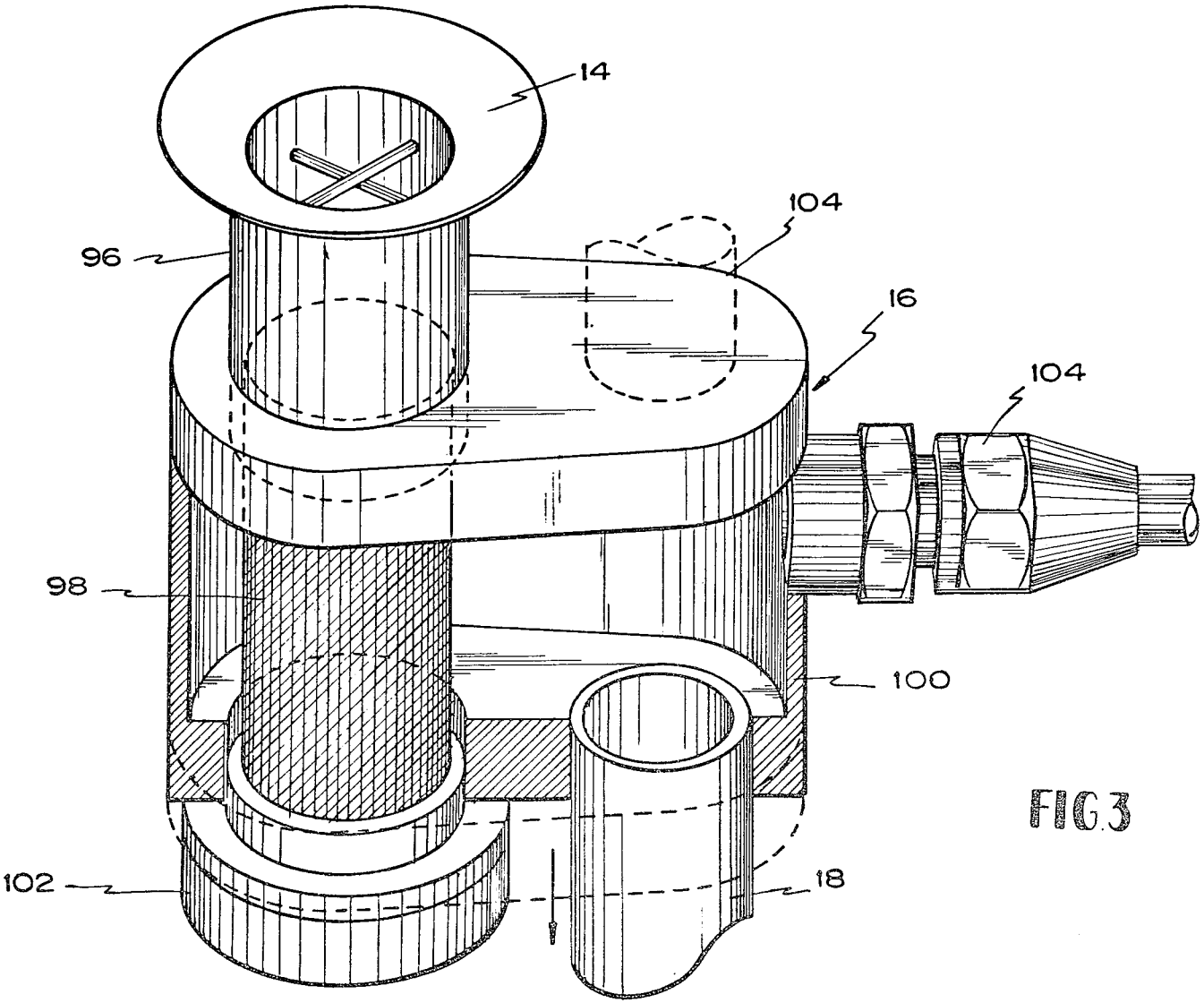
FIG. 3 is a partially trimmed view showing the receiving and filtering element used at the sanitary devices of the system, according to this invention.

This is attained by element 16 more detailed in FIG. 3. Said pressure regulating and filtering device 16 is connected to the drain 14 of said basin 11, by means of a tube 96, entering within a hollow body 100 inside which said tube 96 communicates with a tube 98 formed by a suitable mesh to serve as a filter, in order to trap therein all those bodies contained in the drain water, such as hairs, fibers, etc. Said tube 98 can be withdrawn from said element 100 to clean the same, through a normally sealed opening closed by a plug 102, located at the bottom of said device 16. Also located at the bottom is a connection with the downward tube 18, so as a space or clearance is formed between said mesh tube 98 and tube 18. It is within said space where the air chamber will be formed, and said air chamber can be expelled through said tube 104, connected to the top of said hollow body or box 100, and the open end of which must be located above the maximum level water can reach at the basin, as shown in FIG. 1. However, it should be noted that said tube 104 can be connected into box 100 through the side wall thereof. In this way, air can escape through said tube 104 but water will remain inside the system and will easily pass down to said tank 34 of toilet.

Figure 2:
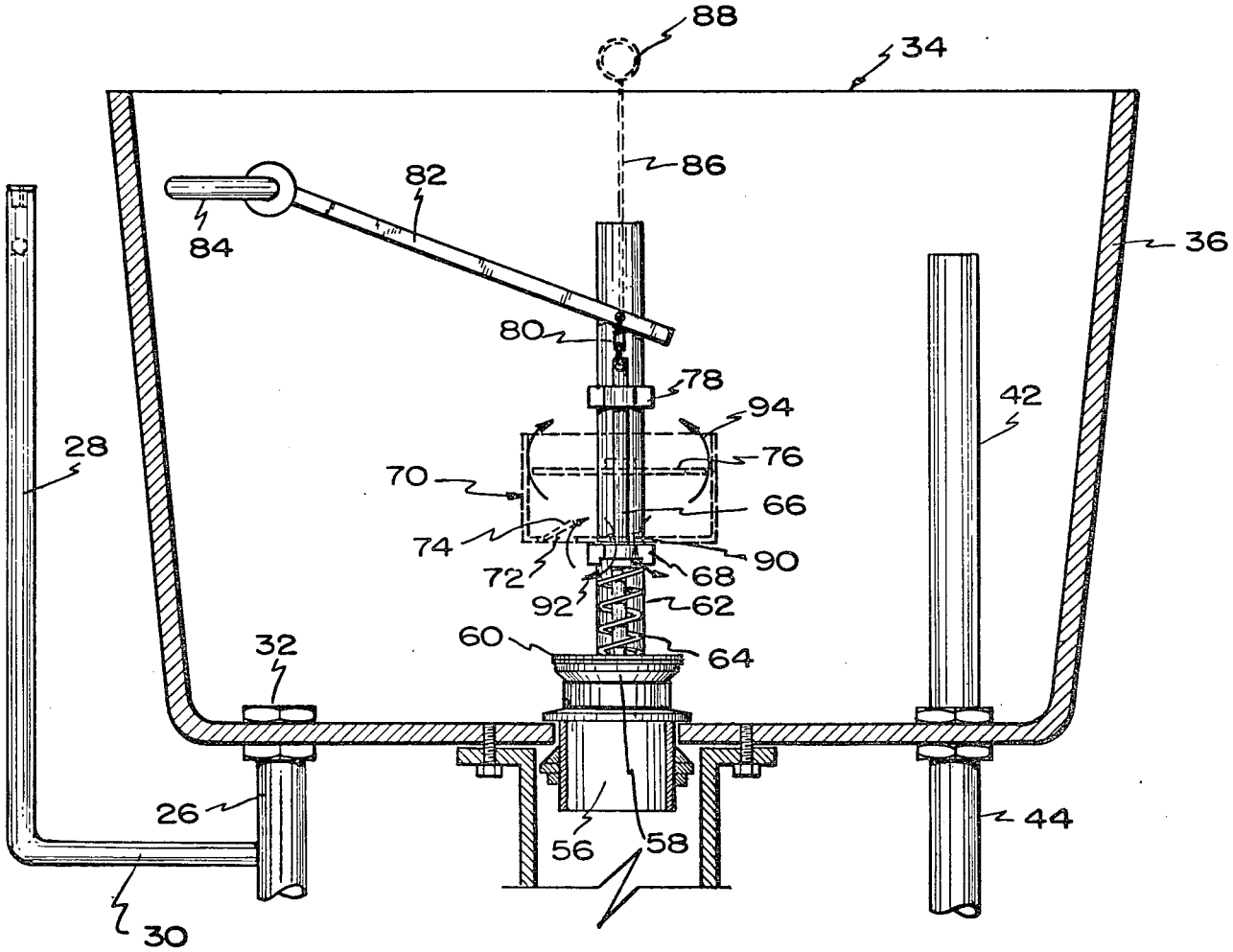
FIG. 2 is a partially sectional and partially elevational view showing the interior of a toilet tank used at the system of FIG. 1.

Turning now to FIG. 2, there is shown in a great detail the interior of the toilet tank 36, with the novel embodiments therein incorporated. As already told, water reaches said tank 36 through said conduct 26, entering through an opening 32. This tank will become full up to a predetermined level, defined by an overflow tube 42, or, in other circumstances, defined by the balance between water column in vertical conducts 18 and 20 (FIG. 1). Water can proceed out the tank through a flushing conduct 56, which is normally closed by a closing plate 60 carrying, at the downwardly facing surface thereof a seal 58, e.g., a rubber seal or the like, in order to provide for the hermetical closing of said flushing opening 56.

This sealing means forms a part of a flushing valve assembly, constituted by a vertical body formed by a drain tube 62. In said tube there are provided plates 68 with guide opening through which a central rod is passed. There is also provided a helical spring 64, located between an upper plate 68 and a plate 60. Said central rod 66 is solidly to said plate 60 and projects upwardly to a plate 78, which plate also carries a guide opening. A chain or cord 80 or the like, is connected at the top end of said central rod, as shown in said Figure.

In a preferred embodiment of this invention, said cord 80 is connected, at the other end thereof, to a lever 82 to be actuated by means of an outer knob 84 in order to elevate said central rod 66 jointly with said plate 60, thus compressing said spring 64 and opening said flushing conduct 56, in order to flush said toilet. The same action is obtained, in another preferred embodiment of this invention by carrying said cord 80 up to a portion 86 vertically directed beyond the cover of said tank, and subjected to a ring 88 or the like, in order to open said conduct 56, as above, through the pulling of said ring upwardly. Of course, in both embodiments, when the power on said spring 64 ceases, said flushing conduct 56 will become closed again, whereby said knob 84 must be actuated or said ring 88 must be kept up until said toilet is wholly flushed. When said power is alleviated, said spring will force said seal 58 against the edge of said conduct 56.

In a third preferred embodiment of this invention, a mechanism capable of maintaining open said flushing valve is provided, without a need to keep said knob 84 or said ring 88 actuated. Said mechanism, generally shown in 70, FIG. 2, is constituted by a cylinder and piston assembly, with said cylinder being unmovable and fastened to said plate 68, by bolts 90. The diameter of said cylinder is several times the height thereof, in order to provide a small displacement of said piston 76 within said cylinder, but enough to admit inside the same an amount of water suitable for obtaining the purposes hereinbelow defined.

As shown in drawings, piston 76 is formed solidly to said central rod 66, so as when the central rod 66 goes up or down, said piston 76 also proceeds upwardly or downwardly jointly. As the motion of said central rod 66 is obtained when power is applied to open said flushing conduct 56, when said rod goes up also said piston 76 is elevated, thus providing a decompression at the lower end of said cylinder. This decompression, or suction action, will act on an inlet valve 72 to allow for water to be introduced from said tank, into said cylinder; said valve 72 preventing the exit of said water due to the provision of a plate 74 capable of being opened inwardly and of being sealed outwardly. It will be obvious that, although just a sole valve is shown, several valves can be employed, so as said cylinder can become full easily and quickly.

As it will be obvious, said spring 64 actuates on piston 76 jointly with said rod 66 and plate 60, to descend the same; however, the volume of water admitted inside said cylinder will oppose this power, thus creating inside said cylinder a compression of said volume of water. Said water will be thus obliged to leak outwardly, as for instance, through the outer edges of said piston, as shown by arrow 94 and/or through openings indicated by arrow 92, formed at the bottom of said cylinder and plate 68. The number and position of said water exits are irrelevant; it is only necessary that a calculation is made so as permit that the time said piston employs in descending from a top position shown in FIG. 2, down to the bottom wall of said cylinder (i.e., the time said plate 60 employs in covering said flushing opening 56 to close the same), is enough for the substantial emptying of said tank 36 in order to facilitate the flushing of the contents of said toilet. Through this assembly, either said knob 84 or said ring 88 can be actuated and then released.

In FIG. 4, a system is illustrated capable of serving a multi-staged building, wherein toilets indicated by letters A, B, C, D and E are to be flushed. A top tank 110 is located at the ceiling of said building, and from said tank white waters will be fed to all of said stages. Said water will enter through tubing 112 down to the tank of toilet A, filling the same and, through said overflow tube 42 (FIG. 1) and tubing 44, water will be fed to the next lower stage. A tubing 114, coming from a wash basin of same stage, identified as A′ communicates, through a horizontal tubing 116, with said toilet tank A, to send thereto the water produced thereby.

Starting at said tubing 44, a descent tube 118 communicates with a sub-system in the next lower stage, formed by a tubing 120 evacuating water from a wash basin B′, a horizontal tubing 122 communicating with the toilet tank B which, through a tubing 44, sends the excess water down to the next lower stage, through a descent tubing 124 connected to a tubing 128 which, in turn, communicates a tubing 126, from a wash basin C′ with the tank of a toilet C. This latter, in turn, sends the excess water through a tubing 44, to the next lower stage by means of a descent tubing 130, which, in turn, communicates with tubing 134 in order to connect a tubing 132 coming from a wash basin D′ with the tank of a toilet D. Again the excess water in said tank of toilet D goes down through a tubing 44 to the next lower stage into which enters through a tubing 134, connected to a tubing 139 wherein tubing 138 from a wash basin E′ ends, communicating thus with said tank of toilet E. As this one in the illustrated example is the lowest stage or level of the building, said tubing 44 is directly connected to a cistern 142, passing through a sedimenting means generally indicated by numeral 140 to be discussed to a greater detail with reference to FIG. 5. Said cistern, in turn, is provided with an outlet tube 144 connected to a water pump 146 which, through an ascent tube 150, sends water from said cistern up to the top tank 110 so the water can be recirculated through all of the stages of said building, as already explained.

Further to the details already explained, the system of this invention as shown in FIG. 4 comprises, in every stage of a building, the use and sending of all of the white waters down to the sub-system of the next lower stage in order to be incorporated into the whole system. This is illustrated at the top level or stage by a shower 113 the white waters of which are sent into a sink which, in turn, is connected by means of tubing 117, to the descent tubing 118 of the next lower stage, wherein the same is incorporated into the system and can be used. The same is true for every stage. Although just a single shower has been illustrated, together with one wash basin and a toilet, it is obvious that several units of every type can be installed in every stage. Furthermore, other types of units can be provided in every stage, for instance, washing bowls, washing machines, etc. Said white waters are incorporated into our system either at the same stage (if the discharge level thereof is above the overflow level of the toilet tank, as already explained relating to FIG. 1) or down to the next lower stage, through elements similar to those identified by numerals 115, 117 in FIG. 4.

Figure 5:
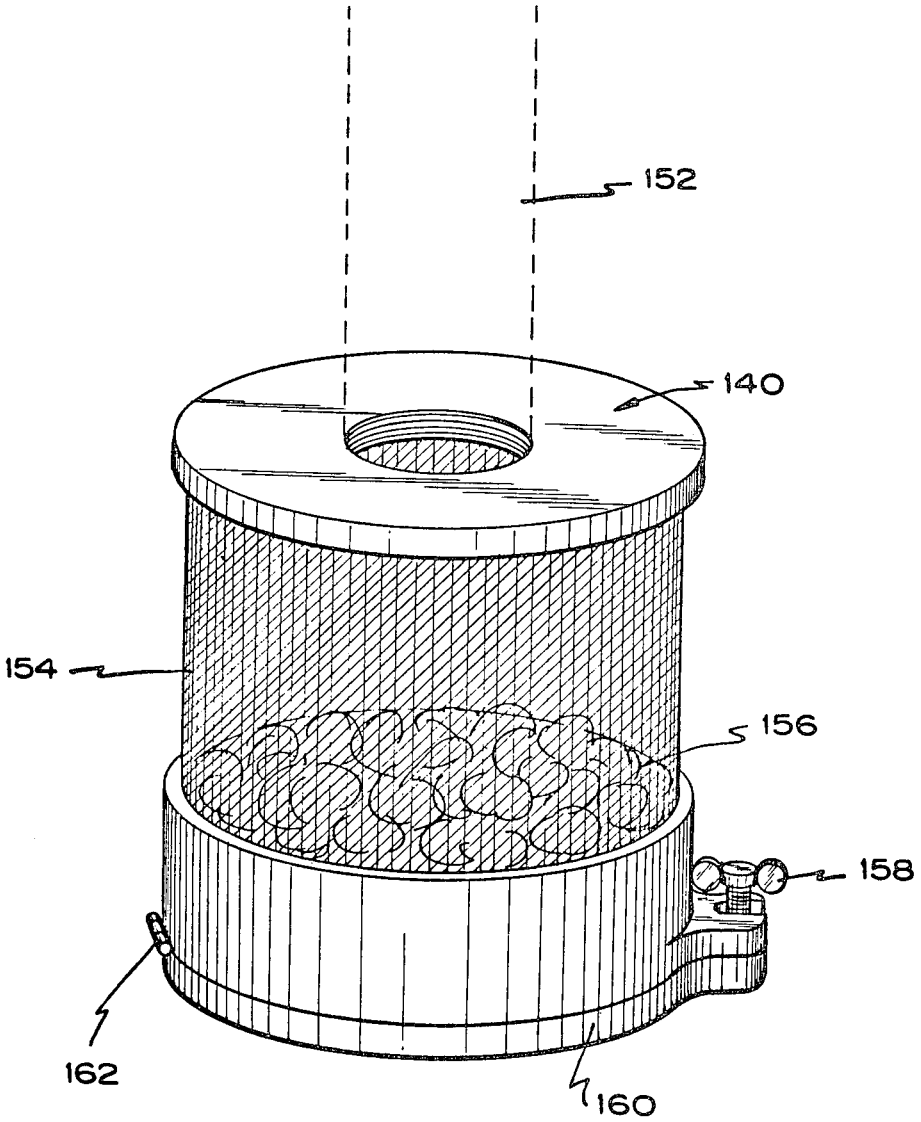
FIG. 5 is a longitudinal sectional view of a sedimenting element used jointly with the cistern shown in FIG. 4 system.

Referring now to FIG. 5, it is shown therein a sedimenter as the one incorporated at the inlet of said cistern 142. A descent tube 152 brings the excess water of the lowest stage directly into the sedimenter body formed by a mesh cylinder 154, closed at the bottom thereof by means of a plate 160, hinged at the bottom of said cylinder by a hinge 162, in order to facilitate the opening of said plate 160. The closed position of said plate is maintained by means of a bolt provided with a butterfly nut 158 so as said bolt can be locked into a prong from said bottom of cylinder. Inside said cylinder a pierced bag is housed. Said bag is full of a sedimenting material, e.g. alumen, (other materials can also be used satisfactorily) and all the water entering into said cistern must pass first through said sedimenter, so as to produce the sedimenting of all the elements capable of obstructing the ways of the system. As will be obvious, the bottom of said sedimenter must remain at all moments above the maximum water level 164 of said cistern 142, as controlled by the outlet 148 (FIG. 4) through which the excess water will be sent directly to sewers.

From the above it can be seen that the objects pointed out at the beginning of this disclosure are obtained and that there are several advantages when using substantially this system as well as the elements forming the same. The versatility of this system is as broad as desired; the only limitation thereof being that this system cannot be used together with ponds, as the germicidal capability of white waters is so high that all bacteriae in charge of the transforation of foecal materials in a pond, would be killed by said waters.

On the other hand, it will be apparent that certain changes, modifications, substitutions and equivalents of parts and elements can be employed without falling out of the scope of this invention, whenever the same are within the broad spirit of the following claims.

What is claimed is:

1. A system for using white waters for flushing toilets in one-stage or multi-staged buildings, comprising at least a sub-system formed by:

at least a toilet and at least a sanitary device capable of producing white waters; said toilet having a water tank with a maximum filling level and a minimum water level;

sanitary connection means between said devices producing white waters and the tank of said toilet or toilets;

every toilet tank having eliminated the inlet or water admitting valve, and being directly connected to the respective sanitary device;

a pressure regulating and filtering means at the sink or outlet of said device or devices producing white waters in order to avoid air columns prone to be formed in said system capable of preventing hydraulic communication between a white waters producing device and the tank in a sub-system;

and overflow means for every toilet tank, located slightly under the maximum filling level of said tank; tank outlet means in fluid communication with said overflow means being capable of connecting with a sewer or with a similar sub-system located at a lower stage of a building;

at least two sub-systems arranged one in a different stage of the same building; there being also incorporated into said system;

a white waters storage tank located above the highest stage of said building, either at top of said building or on top of a different structure;

first tube means connecting said storage tank directly to the tank of a toilet of the top stage sub-system;

second tube means collecting all waters produced at a level under the minimum water level of said tank or tanks of said sub-system, capable of sending the same to a sub-system located at the next lower stage;

said first tube means being in fluid-communication with third tube means connecting said white water producing devices located above the maximum filling level with the first tube means, so that said tank or tanks can be filled by water from said devices or by water from said storage tank, selectively;

said outlet means connecting the overflow of said tank or tanks with the sub-system of the next lower stage; said subsystem of the next lower stage being in fluid communication with a storage means located under the outlet level of said second tube means of the lowest stage of said building, in order that all water in excess coming from all of the stages is stored at said storage means;

pumping means suitable to transfer water from said storage means into said upper tank to recirculate the same; and sedimenting means located at the entrance of said storage means, above the maximum water level thereof, which level is constituted by an outlet connecting with a standard sewage system.

2. In a system according to claim 1, said sedimenting means formed by a cylindrical body; at least a portion of said body constituted by mesh material;

a water entrance means;

and a sedimenting material housing means, located directly opposite to said water entrance means, so as all of the water entering into said sedimenting means contacts first said sedimenting material and then be sent outwardly through said mesh material; and a bottom wall onto which said sedimenting material housing means is supported, capable of being opened in order to remove said material as well as all the sedimented material.

3. A system for using white waters for flushing toilets in one-stage or multi-staged buildings, characterized by comprising at least a sub-system formed by:

at least a toilet and at least a sanitary device capable of producing white waters; said toilet having a water tank with a maximum filling level and a minimum water level;

sanitary connection means between said devices producing white waters and the tank of said toilet or toilets;

every toilet tank having eliminated the inlet or water admitting valve, and being directly connected to the respective sanitary device;

a pressure regulating and filtering means at the sink or outlet of said device or devices producing white waters in order to avoid air columns prone to be formed in said system capable of preventing hydraulic communication between a white waters producing device and the tank in a sub-system;

and overflow means for every toilet tank, located slightly under the maximum filling level of said tank; tank outlet means in fluid communication with said overflow means being capable of connecting with a sewer or with a similar sub-system located at a lower stage of a building;

a water storage building;

aperture means through which water can enter freely into said tank;

discharge means through which the water stored at said container is flushed; said discharge means being normally closed by a spring-biased valve capable of maintaining a water-tight seal on said opening; said valve being functionally connected to a cylinder and piston assembly;

means for maintaining said spring under compression for a time enough for the discharge of substantially all the water contained inside said tank prior to the return of the valve to its bearing position against said opening;

said last means comprising a cylinder element having a lower face against which one end of the spring in the spring biased valve is placed; unmovably arranged above said spring-biased valve, and above said spring; with this latter being compressed between the lower face of said cylinder and said valve;

inlet valve means, formed at the lower or bottom wall of said cylinder, and arranged to be opened inwardly when pressure at the interior of said cylinder is lower than pressure in said tank, and to be closed in contrary cases;

a piston means, capable of being axially moved inside said cylinder, between an inactive position in contact with the closed bottom wall of said cylinder, and an active or suction position, wherein assumes the highest possible position inside said cylinder, so as to create a suction inside the same; said suction allowing for the water existing at said tank to pass into said cylinder and helps in the maintaining of the compression of said spring and the opening of said flushing valve for a time enough for all the water of said tank is discharged through said flushing means, without a need of further manual pressure against said spring.

4. Valve means according to claim 3 wherein said cylinder and piston assembly has a diameter several times greater than the height thereof, so as making necessary just a small displacement of said piston inside said cylinder to fill this latter with water from said tank, through the admission valve in an amount sufficient to maintain opened said discharge or flushing valve for a desired period.

* * * * *

UNITED STATES PATENT AND TRADEMARK OFFICE

CERTIFICATE OF CORRECTION

PATENT NO. : 4,069,521

DATED : January 24, 1978

INVENTOR(S) : Augusto Cuevas Aleman

It is certified that error appears in the above-identified patent and that said Letters Patent are hereby corrected as shown below:

Col. 8, line 16 (Claim 3) "building" should be -- container --.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*